US010337530B2

(12) United States Patent
King et al.

(10) Patent No.: US 10,337,530 B2
(45) Date of Patent: Jul. 2, 2019

(54) PRESS ON HEAT/SPLASH AND ENGINE COOLING FAN ASSEMBLY HAVING SAME

(71) Applicant: Robert Bosch GmbH, Stuttgart (DE)

(72) Inventors: Todd King, Livonia, MI (US); Andrew Leighton, Farmington Hills, MI (US)

(73) Assignee: Robert Bosch GmbH, Stuttgart (DE)

( * ) Notice: Subject to any disclaimer, the term of this patent is extended or adjusted under 35 U.S.C. 154(b) by 351 days.

(21) Appl. No.: 15/329,527

(22) PCT Filed: Aug. 19, 2015

(86) PCT No.: PCT/IB2015/056302

§ 371 (c)(1),
(2) Date: Jan. 26, 2017

(87) PCT Pub. No.: WO2016/030798

PCT Pub. Date: Mar. 3, 2016

(65) Prior Publication Data

US 2017/0211593 A1 Jul. 27, 2017

Related U.S. Application Data

(60) Provisional application No. 62/042,323, filed on Aug. 27, 2014.

(51) Int. Cl.
*F04D 29/70* (2006.01)
*F04D 25/02* (2006.01)
(Continued)

(52) U.S. Cl.
CPC ..... *F04D 29/703* (2013.01); *F04D 25/02* (2013.01); *F04D 29/522* (2013.01);
(Continued)

(58) Field of Classification Search
CPC ..... F04D 25/02; F04D 29/522; F04D 29/542; F04D 29/644; F04D 29/703; F01P 5/02
See application file for complete search history.

(56) References Cited

U.S. PATENT DOCUMENTS 5,180,279 A 1/1993 McLane-Goetz et al.
5,944,497 A * 8/1999 Kershaw ..... F04D 25/082 417/368

(Continued)

FOREIGN PATENT DOCUMENTS

CN 2359513 Y 1/2000
CN 101772652 A 7/2010

(Continued)

OTHER PUBLICATIONS

English translation of First Office Action from the State Intellectual Property Office of the People's Republic of China for Application No. 201580045665.7 dated Jun. 1, 2018 (16 pages).

(Continued)

*Primary Examiner* — Igor Kershteyn
(74) *Attorney, Agent, or Firm* — Michael Best & Friedrich LLP

(57) ABSTRACT

A fan shroud assembly (10) includes a fan shroud (14) having a boss (54) formed thereon, and a shield (22) having an aperture (58) and at least one slot (62) communicating with the aperture to allow deflection of the shield in a region adjacent the aperture. The aperture is smaller than the boss such that the aperture receives the boss with an interference fit, causing deflection of the shield, to secure the shield on the fan shroud.

20 Claims, 4 Drawing Sheets

(51) Int. Cl.

| | |
|---|---|
| ***F04D 29/52*** | (2006.01) |
| ***F04D 29/54*** | (2006.01) |
| ***F04D 29/64*** | (2006.01) |
| *F01P 5/02* | (2006.01) |

(52) U.S. Cl.
CPC ..... *F04D 29/542* (2013.01); *F04D 29/644* (2013.01); *F01P 5/02* (2013.01)

(56) References Cited

U.S. PATENT DOCUMENTS

| | | | | |
|---|---|---|---|---|
| 6,342,741 | B1 * | 1/2002 | Fukui | F04D 25/082 310/60 A |
| 6,384,494 | B1 | 5/2002 | Avidano et al. | |
| 6,427,763 | B1 * | 8/2002 | Matsumoto | H01L 23/467 165/120 |
| 6,556,437 | B1 * | 4/2003 | Hardin | H05K 7/20172 361/679.48 |
| 7,040,862 | B2 * | 5/2006 | Otsuka | F04D 29/542 415/214.1 |
| 7,137,772 | B2 | 11/2006 | Takeuchi et al. | |
| 7,611,327 | B2 * | 11/2009 | Holston | F04D 29/601 415/213.1 |
| 8,057,167 | B2 | 11/2011 | Suzuki et al. | |
| 8,794,887 | B2 | 8/2014 | Nishino | |
| 8,926,244 | B2 | 1/2015 | Sasaki | |
| 2003/0127923 | A1 | 7/2003 | Gubbels | |
| 2003/0127925 | A1 | 7/2003 | Gubbels | |
| 2005/0168080 | A1 | 8/2005 | Simofi-Ilyes et al. | |
| 2006/0012256 | A1 | 1/2006 | Takeuchi et al. | |
| 2006/0103245 | A1 | 5/2006 | Simofi-llyes et al. | |
| 2007/0126299 | A1 | 6/2007 | McLennan | |
| 2011/0273038 | A1 | 11/2011 | Naman et al. | |
| 2012/0013212 | A1 | 1/2012 | Vadillo et al. | |
| 2012/0032542 | A1 | 2/2012 | Liu et al. | |

FOREIGN PATENT DOCUMENTS

| | | | |
|---|---|---|---|
| CN | 102869891 | A | 1/2013 |
| JP | S55152908 | A | 11/1980 |
| JP | H02195007 | A | 8/1990 |
| JP | H0682414 | U | 11/1994 |

OTHER PUBLICATIONS

International Search Report and Written Opinion for Application No. PCT/IB2015/056302 dated Nov. 10, 2015 (12 pages).

The Hillman group 1143 Flat Speed Nut 6-32In. 60-Pack, admitted prior art publicly available at least as early as May 26, 2014. https://www.amazon.com/The-Hillman-Group-1143-60-Pack/dp/B00HYK9FRI/ref=sr_1_8/186-6439087-8456862?s=industrial&ie=UTF8&qid=1401202326&sr=1-8.

Search Report from the National Intellectual Property Administration, P.R. China for Application No. 201580045665.7 dated Jan. 8, 2019 (2 pages).

Notice of Preliminary Rejection from the Korean Intellectual Property Office for Application No. 10-2017-7005330 dated Sep. 20, 2018 (5 pages).

* cited by examiner

PRESS ON HEAT/SPLASH AND ENGINE COOLING FAN ASSEMBLY HAVING SAME

RELATED APPLICATIONS

This Application claims the benefit of U.S. Provisional Patent Application Ser. No. 62/042,323 filed Aug. 27, 2014, the entire content of which is incorporated by reference herein.

BACKGROUND

The present invention relates to the attachment of a heat/splash shield, for example, to an engine cooling fan assembly.

SUMMARY

In one aspect, the invention provides a fan shroud assembly including a fan shroud having a boss formed thereon, and a shield having an aperture and at least one slot communicating with the aperture to allow deflection of the shield in a region adjacent the aperture. The aperture is smaller than the boss such that the aperture receives the boss with an interference fit, causing deflection of the shield, to secure the shield on the fan shroud.

In another aspect, the invention provides a fan shroud assembly having a fan shroud with a plenum portion, a barrel portion, a motor ring, a plurality of stator blades extending between the motor ring and the barrel portion, and a plurality of bosses formed on the motor ring. The assembly further includes a shield configured to fit over the motor ring and having a plurality of apertures corresponding to the plurality of bosses. Each aperture has a plurality of slots communicating therewith to allow deflection of the shield in a region adjacent the aperture. Each aperture is smaller than the corresponding boss such that the apertures receive the bosses with an interference fit, causing deflection of the shield, to secure the shield on the fan shroud.

In yet another aspect, the invention provides a method of installing a shield onto a fan shroud of a fan assembly. The fan shroud has a boss formed thereon and the shield has an aperture and at least one slot communicating with the aperture to allow deflection of the shield in a region adjacent the aperture. The aperture is smaller than the boss. The method includes aligning the aperture with the boss and pressing the shield toward the fan shroud such that the aperture receives the boss and the region adjacent the aperture deflects in a direction away from the fan shroud as the boss passes through the aperture.

Other aspects of the invention will become apparent by consideration of the detailed description and accompanying drawings.

DETAILED DESCRIPTION

Figure 1:
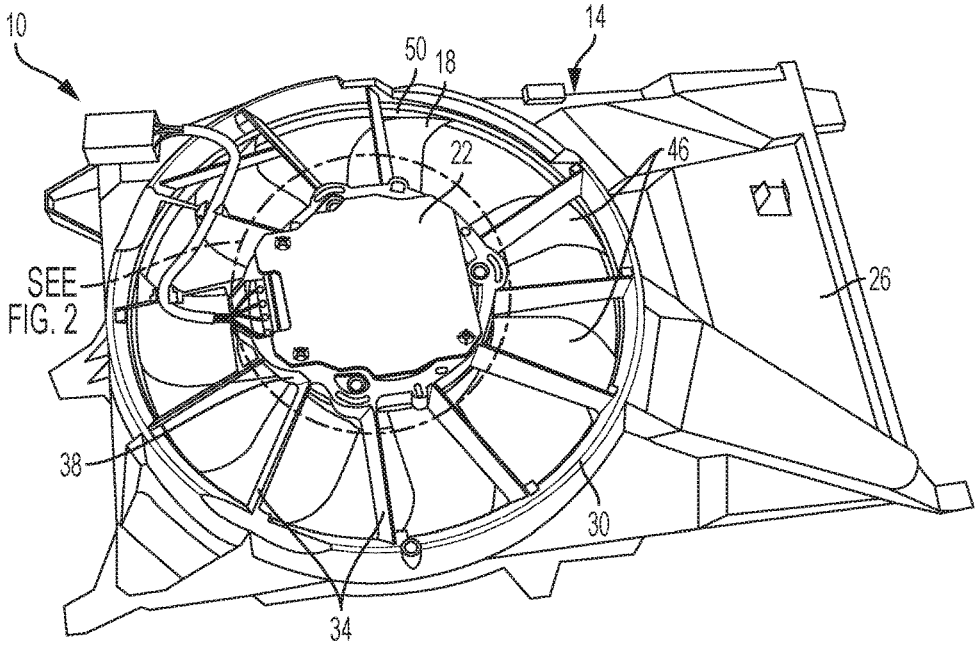
FIG. 1 is a perspective view of a shroud of an engine cooling fan assembly having a press on heat/splash shield arrangement embodying the invention.
Figure 2:
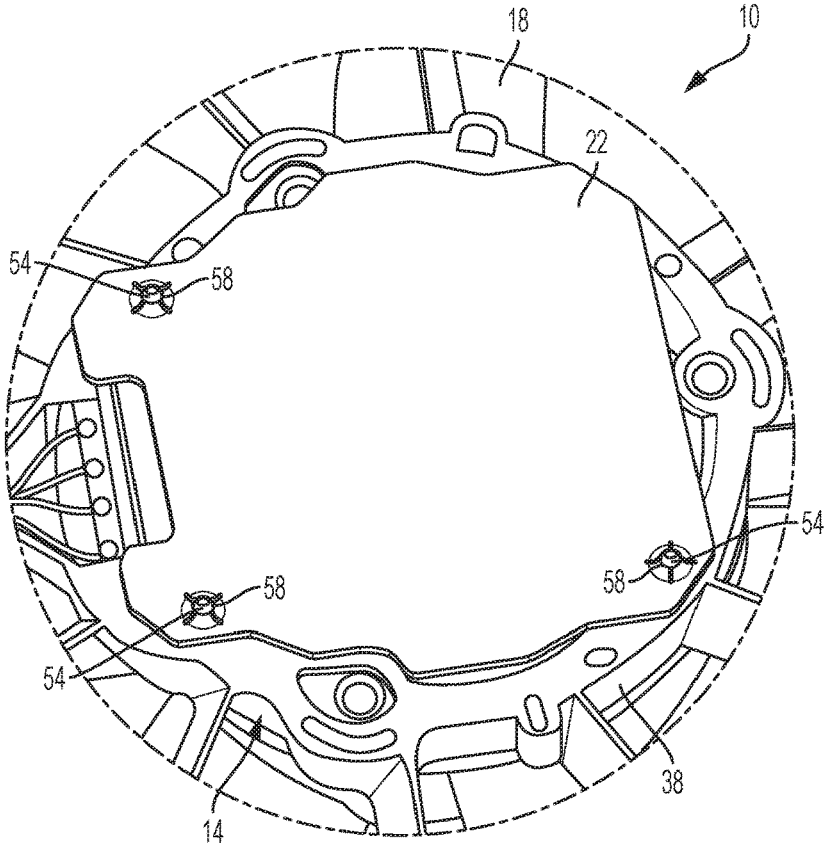
FIG. 2 is an enlarged perspective view of the heat/splash shield provided on the shroud of FIG. 1.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

FIGS. 1-4 illustrate a fan shroud assembly 10 of the present invention. The illustrated fan shroud assembly 10 is for use as an engine cooling fan assembly in a vehicle, although other applications are also contemplated. The fan assembly 10 includes a shroud 14 that supports the remainder of the fan shroud assembly 10 proximate a radiator in a vehicle, a fan 18 rotatable relative to the shroud 14 about a rotation axis, an electric motor (not shown) supported by the shroud 14 for powering the fan, and a heat/splash shield 22 (hereinafter referred to as the "shield 22") positioned adjacent an end of the motor to substantially prevent solid particles (e.g., debris) or liquid (e.g., water) from entering the motor with a cooling airflow that flows around the exterior, or into and through the motor. The shield 22 also prevents damage to the electric motor from radiated heat from the engine exhaust manifold, turbo charger, catalytic converter, or other engine components. The shield 22 can also protect the shroud 14 itself from radiated heat.

The illustrated shroud 14 is an integrally-molded plastic part having a plenum portion 26, a fan barrel portion 30 for receiving the fan 18, stator blades 34 extending radially inwardly from the fan barrel portion 30, and a motor ring 38 supported by the radially inner ends of the stator blades 34. The motor ring 38 supports the motor on the shroud 14. As is understood in the art, the motor includes an end shield (not shown) that can include one or more apertures positioned about the motor end shield to allow a cooling airflow to enter the motor housing and cool the internal components of the motor. Other motors are cooled without airflow entering the motor housing, but instead are cooled with exterior airflow.

The fan 18 is an axial-flow fan that is coupled to the output shaft of the motor for rotation therewith about the rotation axis. The fan 18 includes a central hub that is coupled to the output shaft of the motor, a plurality of blades 46 extending radially outwardly from the hub 42, and a band 50 encircling the tips of the blades 46. It is to be understood that the illustrated fan 18 is just one fan design that can be used in the fan shroud assembly 10. Other fan designs, having different numbers of blades and different blade configurations can also be used. Additionally, in some embodiments the band 50 can be eliminated.

The shield 22 is shown mounted on the motor ring 38 of the shroud 14 to be positioned adjacent the motor end shield. The shield 22 and the motor ring 38 together define a system for reducing the amount of debris and liquid that can enter the motor with the cooling airflow, and for reducing heat transmitted to the motor. The shield 22 and the motor ring 38 are cooperatively configured for attaching the shield 22 to the rear surface motor ring 38 of the shroud 14 without using separate fasteners (i.e. press on assembly). In the illustrated embodiment, one or more (e.g., three) cylinder-shaped bosses 54 are molded into a rear face of the engine cooling fan shroud 14, and more specifically into a rear face of the motor ring 38. In other embodiments, the bosses 54 can have different shapes, and the location and number of the bosses 54 can vary depending upon the particular fan shroud assembly 10. The illustrated shroud 14 is a molded plastic component, such that the bosses 54 are integrally molded with the rest of the shroud 14. In yet other embodiments, the shield 22 can also or alternatively be mounted to the plenum portion 26 of the shroud 14 to protect the plastic shroud material and/or the motor.

Figure 3:
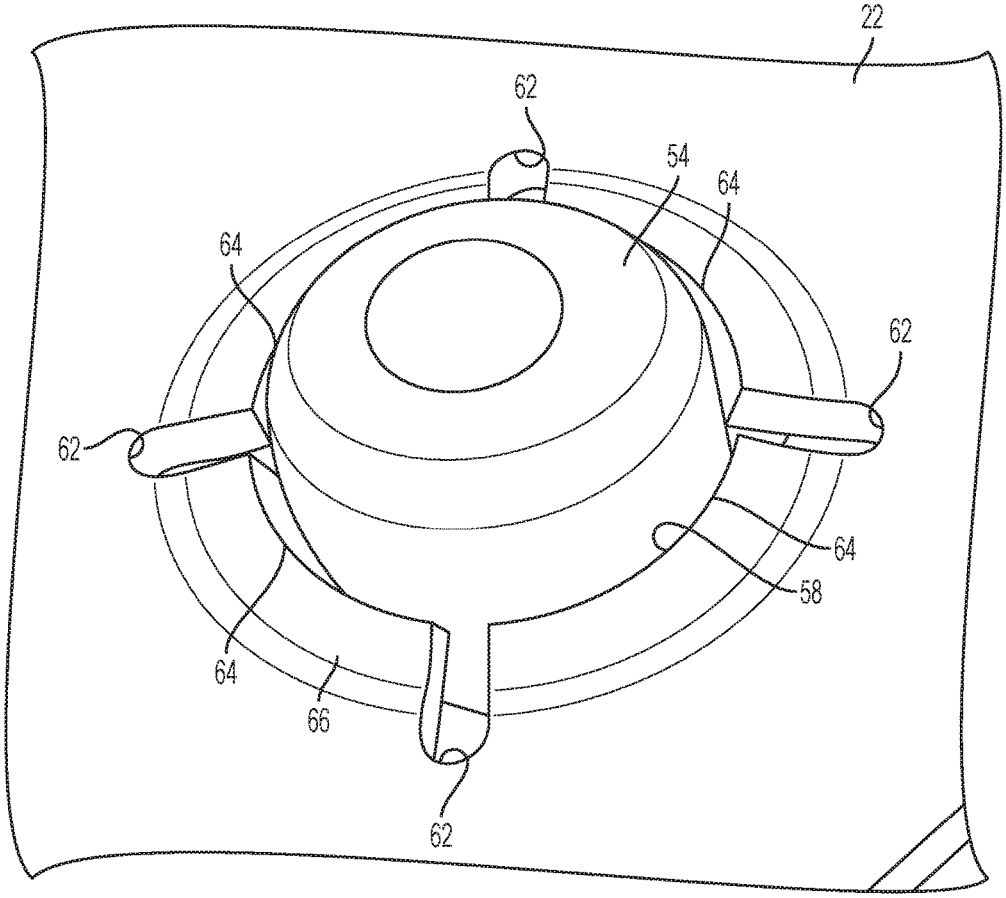
FIG. 3 is a detail view of an interface between a retainer boss of the shroud and an aperture of the heat/splash shield as shown in FIG. 2.
Figure 5:
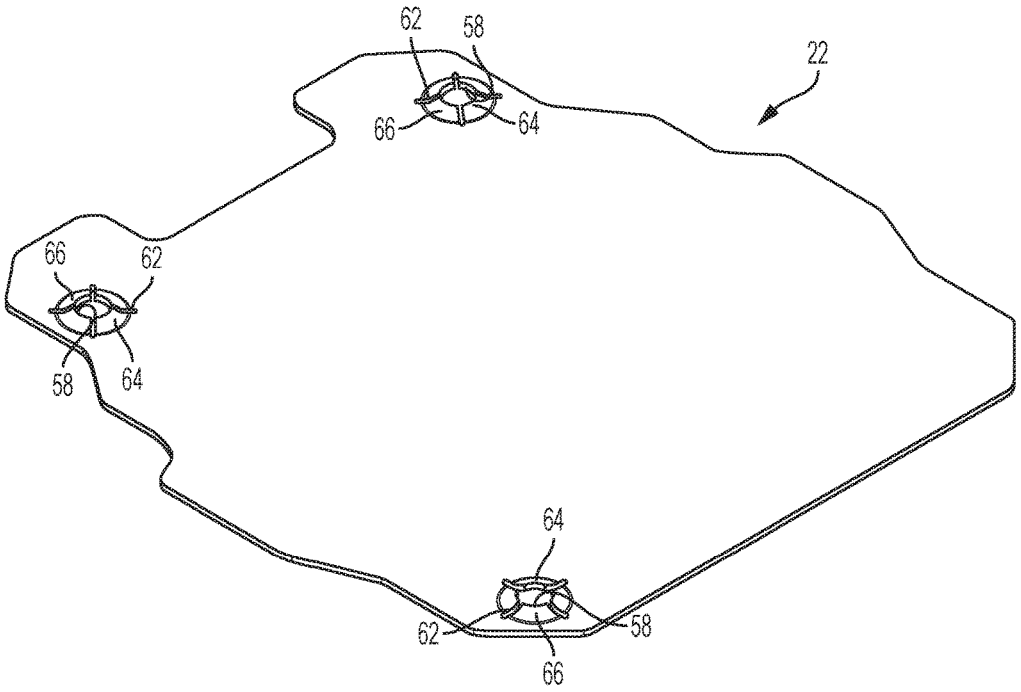
FIG. 5 is a perspective view of the heat/splash shield.

As best seen in FIGS. 3 and 5, the shield 22 has a hole or aperture 58 formed (e.g., stamped) into it with a slightly smaller diameter than the diameter of the boss 54. This creates an interference fit between the boss 54 and shield 22 to secure the shield 22 in place on the boss 54. In the illustrated embodiment, the nominal diameter of the aperture 58 is smaller than the outer circumference of the cylindrical boss 54. The shape of the aperture 58 corresponds generally with the shape of the boss 54, such that other geometries (e.g., square, triangular, etc.) can also be used for the boss 54 and aperture 58 shapes. As best seen in FIG. 5, the apertures 58 in the shield 22 can be tapered (i.e., deformed/bent out of the plane containing the remainder of the shield 22), to facilitate alignment and insertion of the bosses 54 into the apertures 58 and to reduce the assembly force required. The taper also helps to bias the shield 22 against the bosses 54 to reduce any rattling. This tapering can be achieved in the same operation (e.g., stamping) by which the apertures 58 are formed. Once installed, and as evident from FIG. 3, any load to remove the shield 22 from the bosses 54 results in the shield 22, and more specifically the edge of the shield 22 defining the aperture 58, "locking" or "biting" more tightly into the boss 54, thereby inhibiting removal of the bosses 54 from the apertures 58, and therefore inhibiting removal of the shield 22 from the shroud 14. The bosses 54 can also be heat staked, or sonic riveted to further retain the shield 22, although such additional deforming operations would be merely optional. Additionally, the bosses 54 could be formed with a detent, groove, undercut, or other feature that would provide a "snap" type engagement as the bosses 54 enter the apertures 58.

The shield 22 also has a plurality (e.g., four) of spring relief slots 62 associated with each aperture 58. As illustrated, the slots 62 communicate directly with the aperture 58 and form therebetween tabs 64 to facilitate deflection of the shield 22 in a region adjacent the aperture 58 as the bosses 54 enter the slightly smaller apertures 58. More specifically, the tapered region 66 adjacent the aperture 58 (including the tabs 64) will further deflect in the same direction as the original taper direction (i.e., away from the shroud 14) as the boss 54 enters and passes through the aperture 58. The illustrated slots 62 are evenly spaced at 90 degree increments about the aperture 58, and are oriented with longitudinal axes that intersect a center of the aperture 58. In other embodiments, the number and orientation of slots 62 can vary depending on the application and the specific interference fit desired. The radial length of the slots 62, as well as the width of the slots 62, can also be adjusted to control the interference fit between the shroud 14 and shield 22. The slots 62 can be formed (e.g., stamped) in the same operation used to form the apertures 58.

Figure 4:
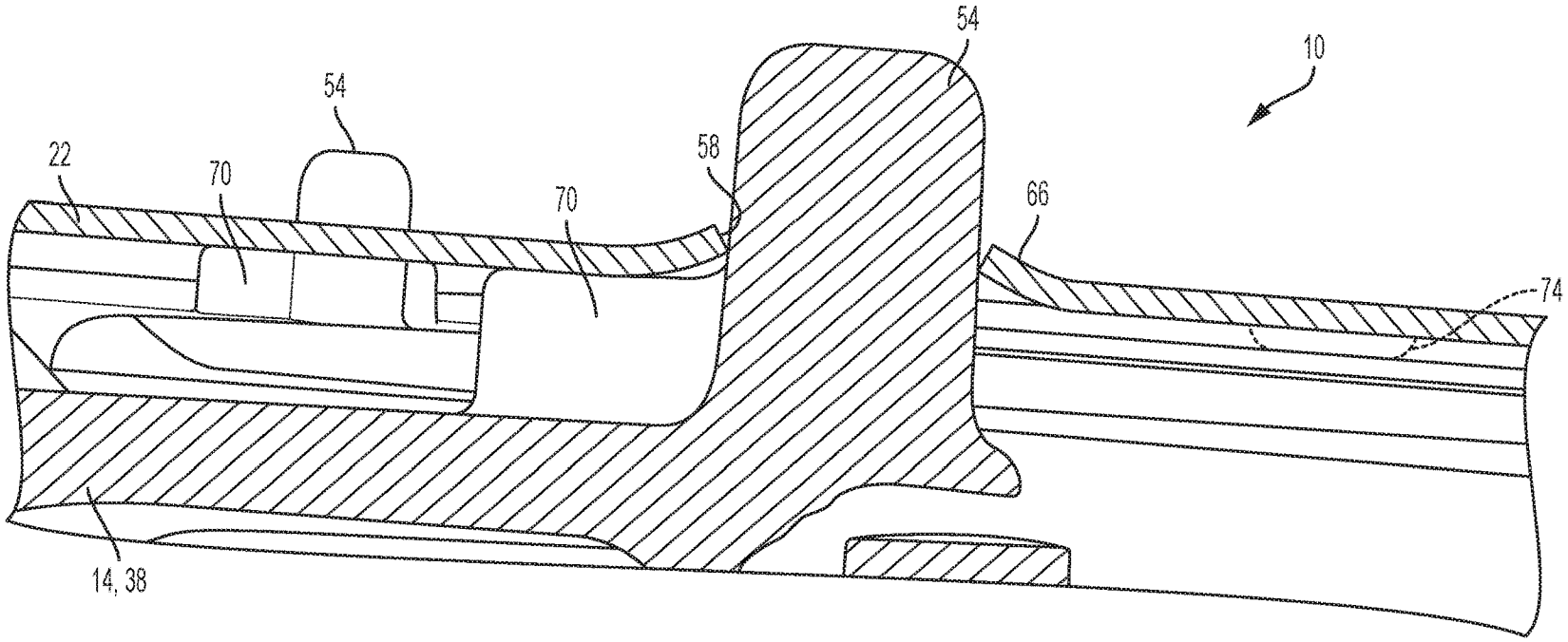
FIG. 4 is a partial section view of the heat/splash shield in position on the shroud.

Controlling the installed height of the shield 22 is important for in-vehicle packaging and heat protection. For example, if space permits, a larger air gap between the shield 22 and the motor will improve heat protection. As shown in FIG. 4, the installed height of the shield 22 can be controlled by shoulders 70 formed into the shroud 14 that abut an underside of the installed shield 22 to limit a distance the bosses 54 can be inserted into the apertures 58. In the illustrated embodiment, a shoulder 70 is molded with the boss 54 to extend from a base of the boss 54. In other embodiments, the shoulder 70 could be a separate projection from the boss 54 that is formed on the shroud 14 beneath the shield 22. In yet other embodiments, the shield 22 can contain a projection 74 (shown in phantom in FIG. 4) or other feature formed (e.g., stamped) into the shield 22 to abut the shroud 14 for controlling the installed height by limiting the distance the bosses 54 can be inserted into the apertures 58.

In the illustrated embodiment, the shield 22 is made of metal (e.g., steel or aluminum), with the apertures 58, the slots 62, the tapered region 66, and perhaps also the projection 74 formed via a stamping operation. The metal edges defining the apertures 58 are sharp and hard relative to the smoother and softer plastic bosses 54 to facilitate the edges biting into the bosses 54 to secure the shield 22 on the bosses 54. The shield 22 can be coated with a rust or oxide-inhibitive material which improves service life and which can be light in color (white, silver, or mirrored) to reflect radiant heat waves and to minimize energy absorption. The coatings can also be black in color to meet underhood visual requirements. In other embodiments, the shroud 14 could be made from aluminum and the shield 22 could be made from steel. Other materials can also be used, however, it is preferred that the material of the bosses 54 be softer than the material of the shield 22 to provide the above-described biting of the edges of the shield 22 into the bosses 54.

The method of installing the shield 22 onto the shroud 14 will now be described. The shield 22, which has been designed to cooperate with the bosses 54 on the shroud 14, is positioned over the motor ring 38 with the apertures 58 aligned with the corresponding bosses 54. The shield 22 is oriented such that the tapered regions 66 project in a direction away from the shroud 14. The shield 22 is then pressed toward the shroud 14 such that the apertures 58 receive the corresponding bosses 54 and the tapered regions 66 and tabs 64 further deflect in a direction away from the shroud 14 as the bosses 54 pass through the apertures 58. Pressing continues until the underside of the shield 22 abuts the shroud 14. This can happen by virtue of the underside of the shield 22 abutting the shoulders 70 and/or the projection (s) 74 on the underside of the shield 22 abutting the shroud 14.

Compared to existing shielding solutions, the press on shield 22 of the current invention enables simplified shroud tool design, robust shroud molding features, reduced cost for the manufacturing and the assembly process, fewer individual components (screws, rivets, clips, etc.) used in the overall cooling fan assembly, reduced cost of heat shield, improved durability of heat shield from impact, and improved recyclability. Lower unit cost and assembly cost can be achieved with the press on metal shield 22 than a self-adhesive heat shield, or metal stamped heat shields having clips or locking features with much more complicated geometries than the apertures 58 and slots 62. Similarly, the shroud 14 is simplified over other shrouds due to the non-complex geometry of the bosses 54 as compared to prior art shrouds requiring more complicated resilient locking structures.

Various features of the invention are set forth in the following claims.

The invention claimed is:

1. A fan shroud assembly comprising:

a fan shroud having a boss formed thereon; and a shield having an aperture and at least one slot communicating with the aperture to allow deflection of the shield in a region adjacent the aperture, the aperture being smaller than the boss such that the aperture receives the boss with an interference fit, causing deflection of the shield, to secure the shield on the fan shroud.

2. The fan shroud assembly of claim 1, wherein the at least one slot includes a plurality of slots.

3. The fan shroud assembly of claim 1, wherein the at least one slot includes four slots evenly spaced about the aperture.

4. The fan shroud assembly of claim 1, wherein the boss is cylindrical in shape and wherein the aperture is circular in shape.

5. The fan shroud assembly of claim 1, wherein the region of the shield adjacent the aperture is tapered.

6. The fan shroud assembly of claim 5, wherein the shield is planar, and wherein the tapered region of the shield adjacent the aperture defines a deviation from a remainder of the planar shield.

7. The fan shroud assembly of claim 1, wherein the fan shroud and the boss are integrally formed of plastic, and wherein the shield is metal.

8. The fan shroud assembly of claim 1, wherein the fan shroud further includes a shoulder formed thereon, the shoulder abutting an underside of the shield to limit a distance the boss can be inserted into the aperture.

9. The fan shroud assembly of claim 8, wherein the shoulder extends from a base of the boss.

10. The fan shroud assembly of claim 1, wherein the shield includes a projection on an underside thereof, the projection abutting the fan shroud to limit a distance the boss can be inserted into the aperture.

11. The fan shroud assembly of claim 1, wherein the fan shroud includes a plurality of bosses and wherein the shield includes a corresponding plurality of apertures, each aperture having at least one slot communicating therewith to allow deflection of the shield in a region adjacent the aperture, each aperture being smaller than the corresponding boss such that the apertures receive the bosses with an interference fit, causing deflection of the shield, to secure the shield on the fan shroud.

12. The fan shroud assembly of claim 1, wherein the shield is metal and is coated with an oxide-inhibitive material.

13. The fan shroud assembly of claim 1, wherein the fan shroud further includes a plenum portion, a barrel portion, a motor ring, and a plurality of stator blades extending between the motor ring and the barrel portion, and wherein the boss is formed on the motor ring.

14. A fan shroud assembly comprising:

a fan shroud having a plenum portion, a barrel portion, a motor ring, a plurality of stator blades extending between the motor ring and the barrel portion, and a plurality of bosses formed on the motor ring; and a shield configured to fit over the motor ring and having a plurality of apertures corresponding to the plurality of bosses, each aperture having a plurality of slots communicating therewith to allow deflection of the shield in a region adjacent the aperture, each aperture being smaller than the corresponding boss such that the apertures receive the bosses with an interference fit, causing deflection of the shield, to secure the shield on the fan shroud.

15. The fan shroud assembly of claim 14, wherein the regions of the shield adjacent the apertures are tapered.

16. The fan shroud assembly of claim 14, wherein the motor ring further includes a shoulder formed thereon, the shoulder abutting an underside of the shield to limit a distance the bosses can be inserted into the apertures.

17. The fan shroud assembly of claim 16, wherein the shoulder extends from a base of one of the plurality of bosses.

18. The fan shroud assembly of claim 14, wherein the plurality of slots communicating with each aperture define therebetween a plurality of tabs defining the region adjacent the aperture, each of the tabs deflecting away from the fan shroud as the apertures receive the bosses.

19. A method of installing a shield onto a fan shroud of a fan assembly, the fan shroud having a boss formed thereon and the shield having an aperture and at least one slot communicating with the aperture to allow deflection of the shield in a region adjacent the aperture, the aperture being smaller than the boss, the method comprising:

aligning the aperture with the boss; and pressing the shield toward the fan shroud such that the aperture receives the boss and the region adjacent the aperture deflects in a direction away from the fan shroud as the boss passes through the aperture.

20. The method of claim 18, further comprising:

abutting an underside of the shield against a shoulder formed on the fan shroud, thereby limiting a distance the boss passes through the aperture.

* * * * *